United States Patent [19]

Ruf

[11] 4,090,823

[45] May 23, 1978

[54] FLUID-COOLED ROTARY PISTON FOR WANKEL-TYPE MECHANISM

[75] Inventor: Max Ruf, Obereisesheim, Germany

[73] Assignee: Audi NSU Auto Union Aktiengesellschaft, Neckarsulm, Germany

[21] Appl. No.: 769,573

[22] Filed: Feb. 17, 1977

[30] Foreign Application Priority Data

May 15, 1976 Germany ..... 2621720

[51] Int. Cl.[2] ..... F01C 1/02; F01C 21/06; F01C 21/08

[52] U.S. Cl. ..... 418/94

[58] Field of Search ..... 418/91, 94; 123/8.01

[56] References Cited

U.S. PATENT DOCUMENTS

| | | | |
|---|---|---|---|
| 3,042,009 | 7/1962 | Froede | 418/94 |
| 3,102,682 | 9/1963 | Paschke | 418/91 |
| 3,204,614 | 9/1965 | Huber | 418/91 |
| 3,266,468 | 8/1966 | Peras | 123/8.01 |
| 3,302,624 | 2/1967 | Tatsutomi | 418/94 |
| 3,877,849 | 4/1975 | Wieland | 418/91 |
| 4,025,245 | 5/1977 | Goloff | 418/94 |

FOREIGN PATENT DOCUMENTS

| | | | |
|---|---|---|---|
| 921,849 | 3/1963 | United Kingdom | 123/8.01 |

*Primary Examiner*—John J. Vrablik
*Attorney, Agent, or Firm*—Arthur Frederick

[57] ABSTRACT

The fluid-cooled rotary piston for a Wankel-type mechanism has a plurality of intersecting flank surfaces to form a multi-sided profile and a hub portion by which it is supported for rotation on a mainshaft. The rotary piston also has a closed-loop passageway for each flank surface extending in close spaced relation to the side faces of the rotor and the intersection of the flank surfaces. An inlet passage is provided for each closed-loop passageway to conduct to the latter, as the rotary piston rotates, pressurized cooling fluid from a source thereof. An outlet passage is provided for each closed-loop passageway to conduct heated cooling fluid from the latter to an area adjacent the hub portion. The outlet passage may be provided with a restricted flow area to insure that the associated closed-loop passageway is maintained full of cooling fluid.

5 Claims, 4 Drawing Figures

FLUID-COOLED ROTARY PISTON FOR WANKEL-TYPE MECHANISM

This invention relates to rotary pistons for Wankel-type mechanisms and, more particularly, to liquid-cooled rotary pistons for such mechanisms.

BACKGROUND OF INVENTION

In Wankel-type mechanisms it is conventional to provide rotary pistons which are provided with hollow spaces or cavities through which is circulated oil for absorbing heat from the rotary piston. These heretofore known liquid-cooled rotary pistons for Wankel-type mechanisms are exemplified in the following U.S. Pat. Nos.

| | | |
|---|---|---|
| July 3, 1962 | Froede et al | 3,042,009 |
| April 6, 1965 | Bentele et al | 3,176,915 |
| April 6, 1965 | Sollinger | 3,176,916 |
| September 7, 1965 | Huber | 3,204,614 |
| February 7, 1967 | Tatsutomi | 3,302,624 |

It has been found in engines having these well known liquid-cooled rotary pistons that the engines are slow to achieve the optimum operating temperature because of the combined effects of the relatively large amounts of cooling fluid circulated through the rotary piston cavities and the large heat-dissipating surface of the rotary piston. It has also been found in these conventional rotary pistons, except the type disclosed in the aforesaid patent to Huber, that the cooling liquid in the rotary piston is flung both radially inwardly and outwardly under the effects of the changing centrifugal forces. This movement of liquid mass results in a considerable loss of power.

It is therefore an object of this invention to provide a fluid-cooled rotary piston for a Wankel-type mechanism which permits the mechanism to rapidly rise to its optimum operating temperature and minimizes power losses due to cooling liquid motion.

It is another object of the present invention to provide a fluid-cooled rotary piston for a Wankel-type mechanism which quickly and effectively removes heat from the area adjacent the sealing elements carried by the rotary piston.

SUMMARY OF THE INVENTION

Accordingly, the present invention contemplates a fluid-cooled rotary piston for a Wankel-type mechanism, as for example, an internal combustion engine, expansion engine, compressor or pump. The rotary piston comprises a body having opposite side faces and a plurality of flank surfaces which intersect each other at their opposite ends to form apex portions so that the rotary piston has a multi-sided configuration. The body has a centrally located hub portion by which the rotary piston is supported on the eccentric portion of a mainshaft for rotation within a cavity formed by a housing having end walls spaced apart by a peripheral wall of trochoidal shape. A first passage means is provided in the body to extend adjacent each flank surface and adjacent each intersection of the points of intersection of the flank surfaces. A second passage means is provided in the body to extend adjacent each flank surface and each side face to communicate at opposite ends thereof with each of said first passage means to thereby form for each flank surface a closed-loop passageway. An inlet means is disposed in said body to communicate each of the closed-loop passageways with a source of pressurized cooling fluid, such as a lubricant pump, to deliver cooling fluid to the closed-loop passageways. To conduct heated cooling fluid from the closed-loop passageway, an outlet means is disposed in said body to communicate the closed-loop passageway with an area adjacent and surrounding the hub portion of the rotary piston.

In a narrower aspect of the invention, the closed-loop passageways extend in close, spaced relationship with side seal strips carried in each side face of the rotary piston and apex assemblies carried in the apex portions of the rotary piston.

In another narrower aspect of the present invention, the inlet means includes a radially extending passageway and a radial passageway in the eccentric portion of the mainshaft which intermittently come into direct communication with each other as the rotary piston rotates relative to the mainshaft.

It is also contemplated by the present invention that the rotary piston may be a built-up rotary piston in which the component parts, such as hub, flanks and side faces, are separately fabricated by pressing, forging, sintering or casting and connected together by soldering or welding. Such rotary pistons are disclosed in the following U.S. Pats. Nos.:

| | | |
|---|---|---|
| October 23, 1962 | Froede et al | 3,059,585 |
| April 15, 1975 | Wieland | 3,877,849 |
| November 18, 1975 | Wieland | 3,920,358 |

A build-up rotary piston, according to this invention, is deemed preferable because the closed-loop passageways can be more easily and cheaply provided for in the structure, it being almost impossible to produce toe closed-loop passageways by cores in a cast, one-piece rotary piston.

A constriction may also be provided in each of the outlet means to restrict the flow of fluid therethrough to thereby control flow of fluid through the associated closed-loop passageway and insure that the closed-loop passageway is maintained full of cooling fluid.

BRIEF DESCRIPTION OF THE DRAWINGS

The invention will be more fully understood from the following detailed description thereof when considered in connection with the accompanying drawing wherein but one embodiment of the invention is illustrated by way of example, and in which.

DESCRIPTION OF PREFERRED EMBODIMENT

Figure 1:
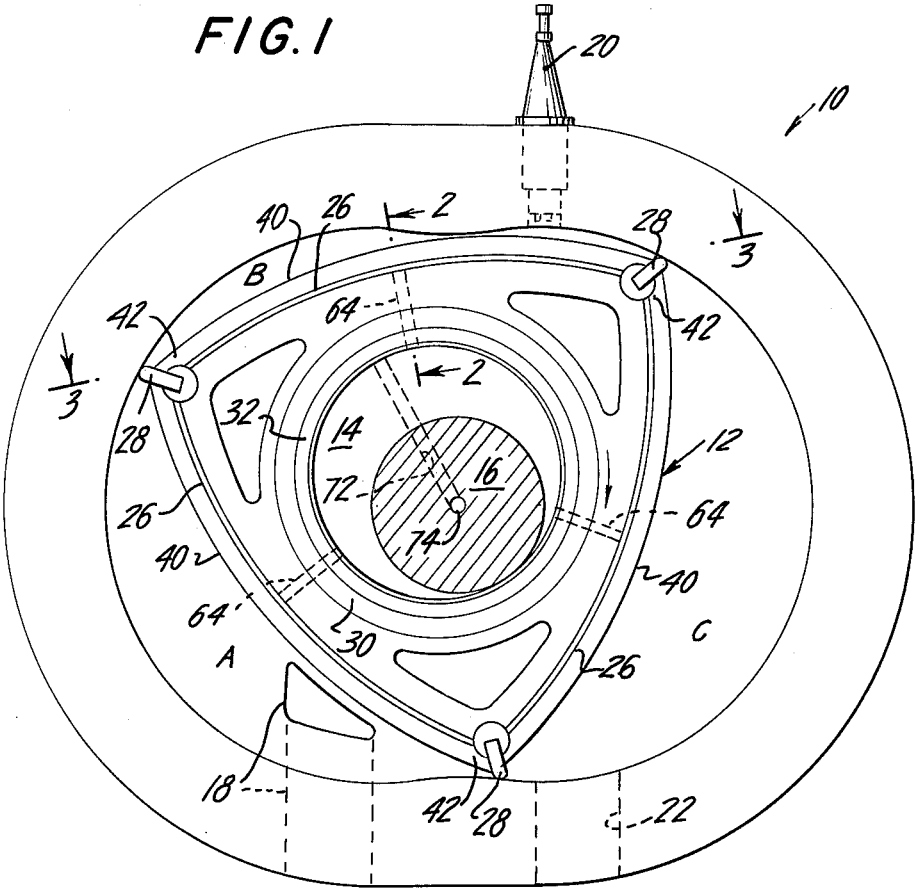
FIG. 1 is a transverse cross-sectional view through a rotary internal combustion engine of the Wankel-type having a rotary piston accoding to this invention.

Now referring to the drawing, and more specifically to FIG. 1, the reference number 10 generally designates a rotary mechanism of the Wankel-type having a rotary piston 12 according to this invention. The rotary mechanism 10 is illustrated and will be described as a rotary internal combustion engine, it being understood that rotary piston 12 may be employed in other rotary mechanisms, such as expansion engines, pumps and compressors, without departing from the spirit and scope of this invention.

The rotary mechanism 10, as shown in FIG. 1, comprises a housing which together with a trochoidal inner surface defines a two-lobe cavity in which rotary piston 12 is supported by an eccentric portion 14 of a driveshaft or mainshaft 16. The rotary piston 12 defines with the housing cavity a plurality of working chambers designated A, B and C. These chambers successively expand and contract in volumetric size as rotary piston 12 planetates relative to the housing.

The rotary mechanism 10 operates so that each chamber undergoes four successive cycles of intake, compression, expansion and exhaust, and to this end, an inlet or intake port 18, an ignition means such as a spark plug 20, and an outlet or exhaust port 22 are provided in the housing. The intake port 18 is in communication with a source of combustible fluid, such as a mixture of air and gasoline from a carburetor (not shown). The spark plug 20 is positioned to ignite the combustible mixture which has passed into chamber A, through intake port 18, and compressed by rotary piston 12. The products of combustion are discharged on the exhaust cycle from working chamber C through exhaust port 22. To maintain each of the working chambers A, B and C in fluid-tight independence from each other and surrounding areas, rotary piston 12 has a sealing grid system which comprises, as shown only in FIG. 1, side seal strips 26, apex seal assemblies 28, and oil seal rings 30.

Figure 2:
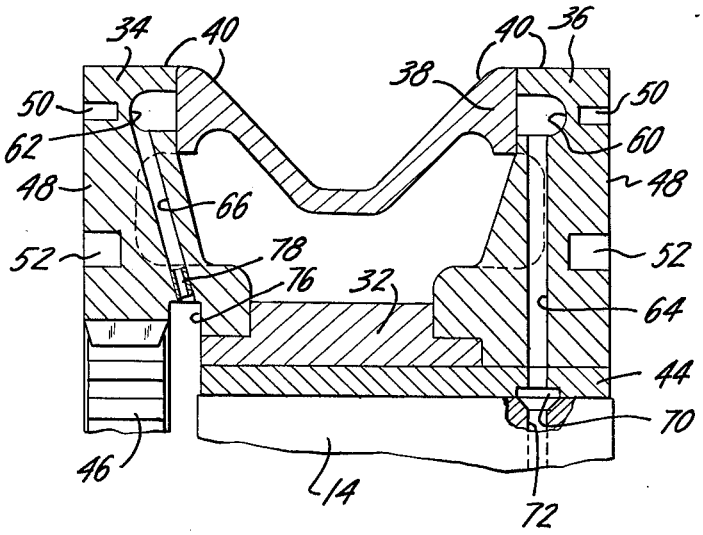
FIG. 2 is a cross-sectional view taken along line 2—2 of FIG. 1, on a somewhat enlarged scale and with seal elements removed.
Figure 3:
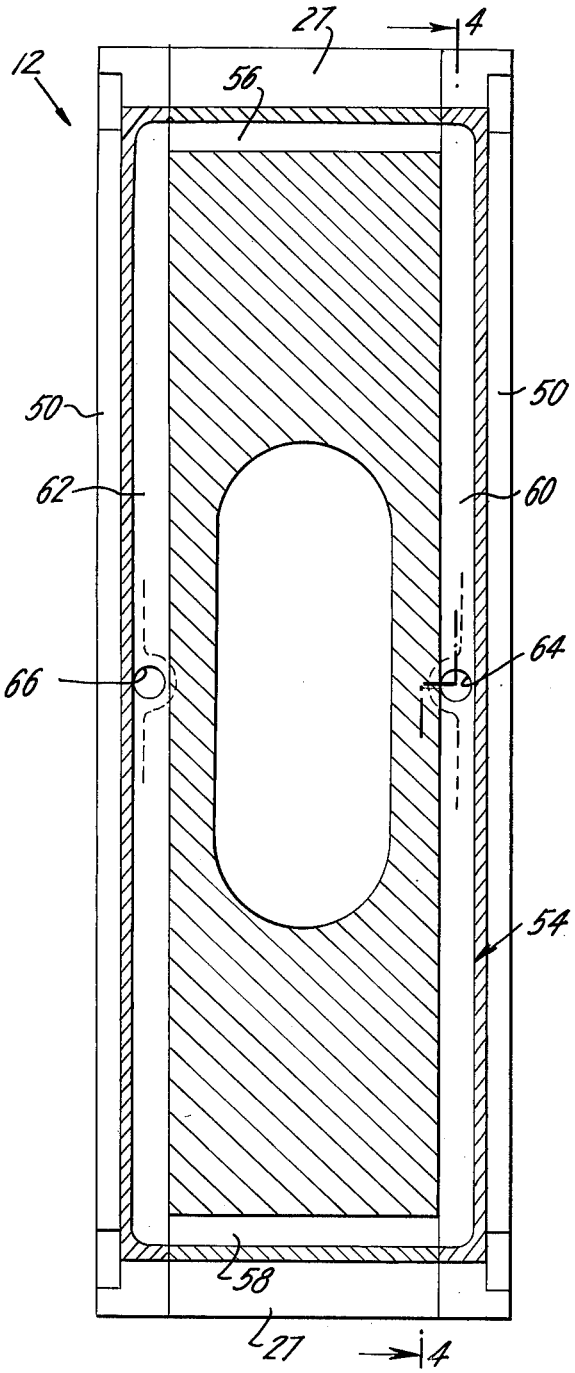
FIG. 3 is a view in cross-section taken substantially along line 3—3 of FIG. 1, on the same scale as FIG. 2 and with seal elements omitted.
Figure 4:
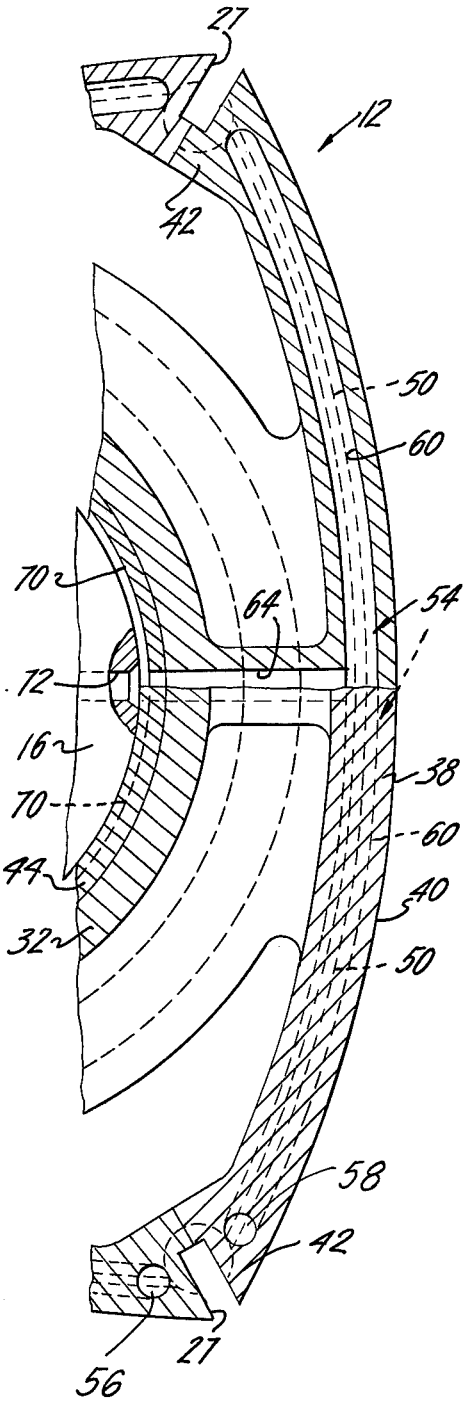
FIG. 4 is a sectional view taken substantially along line 4—4 of FIG. 3.

As best shown in FIGS. 2 to 4, rotary piston 12 comprises a body made up of a hub portion or part 32, spaced side walls 34 and 36 and a plurality of flank members 38 secured together in any suitable manner, such as by electron beam welding, soldering or the like, to form a unitary structure. The flank members 38 have outer surfaces which together with the outer edge surfaces of side walls 34 and 36 form flank surfaces 40 which intersect each other at their opposite ends to form a plurality of apex portions 42. A sleeve bearing 44 is disposed in the hub portion 32 to provide a wear surface between eccentric portion 14 and rotary piston 12. An internal ring gear 46 is formed in side wall 34 or is a separate member suitably secured to side wall 34. Each outer face 48 of side walls 34 and 36 is provided with arcuate grooves 50 for receiving side seal strips 26 and an annular recess 52 for receiving an oil seal ring 30. Also, as is best shown in FIGS. 3 and 4, apex seal grooves 27 are formed in the apex portions 42 for receiving apex seal assemblies 28. These grooves 27, as shown, may be defined between the notched ends of adjacent flank members 38.

As best shown in FIGS. 2, 3 and 4, rotary piston 12, according to this invention, is provided with a closed-loop cooling passageway 54 for each flank surface 40. The closed-loop passageway 54 consists of passages 56 and 58 and passages 60 and 62, which communicate at their opposite ends with each other. The passages 56 and 58 are each disposed to extend in the apex portions 42 parallel to the axis of the hub part 32 and adjacent and parallel to an apex seal groove 27. Each of the passages 60 and 62 arcuately extend in a flank member 38 adjacent flank surface 40 and an outer face 48 of side wall 34 or 36. The passages 60 and 62 extend concentrically with arcuate grooves 50. As best shown in FIG. 2, passages 60 and 62 may be defined between grooves in side walls 34 and 36 and the abutting surfaces of flank members 38. To provide for flow of cooling liquid into and through closed-loop cooling passages 54, each closed-loop cooling passage 54 has an inlet passage 64 and an outlet passage 66.

Each inlet passage 64 extends radially from a mid-point of the length of an associated passage 60 through side wall 36 and bearing 44. As shown in FIGS. 2 and 4, passage 64 communicates at its end opposite from passage 60 with an annular groove 70 formed in the inner surface of bearing 44. Each of the inlet passages 64 is supplied with cooling liquid by a coolant supply means which includes a radial bore 72 extending through mainshaft 16 and eccentric portion 14 and a supply passage 74 extending axially through mainshaft 16 and communicating with radial bore 72. The supply passage 74 is supplied with coolant, such as oil, under pressure from a suitable source such as an oil pump (not shown).

Each outlet passage 66 extends, similar to inlet passage 64, radially from a mid-point between the ends of an associated passage 62 and through side wall 34 to an annulus 76 adjacent internal gear 46. To insure that closed-loop cooling passage is maintained full of coolant, a flow-constricting member 78 is provided in outlet passage 66. This flow-constricting member 78 throttles coolant flow through outlet passage 66 so that a requisite pressure drop is provided through closed-loop cooling passage 66 with attendant adequate cooling of the rotor adjacent the seal elements 26 and 28.

As previously stated, rotary piston 12, according to this invention, may be formed or built-up from separate elements secured together in any suitable manner as is well known and disclosed in the aforementioned U.S. Patents. More specifically, as is shown in FIGS. 2, 3 and 4, rotary piston 12 may comprise side walls 34 and 36, hub part 32 and flank members 38 which are separate elements formed by pressing, forging, sintering or casting and joined together by electron-beam welding, soldering or brazing. In the alternative, the hub part 32 may form part of side wall 34 or 36 and/or all of the flank members 38 may be formed of one piece rather than separate members. Also it is possible to make the flank members 38 and hub part 32 a single piece without departure from the scope and spirit of the invention.

In the operation of rotary piston 12, during relative rotation between eccentric portion 14 of mainshaft 16 and rotary piston 12, coolant, such as a lubricating oil, is supplied from a pressurized source thereof (not shown) via supply passage 16 and radial bore 72 to an annulus 70 in bearing 44. From annulus 70 the coolant flows to each of the closed-loop cooling passages 54 via inlet passage 64. Thereafter the coolant flows, through passages 60, 56 and 58, into passage 62 of each of the closed-loop cooling passages 54. From each of the passages 62, the heated coolant discharges through outlet passages 66 (see FIG. 2) into annulus 76 and thence into the space adjacent internal gear 46 to lubricate and cool the latter and the pinion gear (not shown) with which it is in mesh as well as bearing 44. From this space the coolant is carried off through suitable ports (not shown) and collected in a pump (not shown) for recirculation through a cooler (not shown) and rotary piston 12 by a pump (not shown).

It is believed now readily apparent that the present invention provides an improved liquid-cooled rotary piston for a rotary piston mechanism which permits the rotary piston mechanism to quickly arrive at optimum operating temperature without loss of power. It also provides for removal of heat quickly and effectively from the sealing elements carried by the rotary piston to thus increase the operative life of the sealing elements.

Although but one embodiment of the invention has been illustrated and described in detail, it is to be expressly understood that the invention is not limited thereto. Various changes can be made in the arrangement of parts without departing from the spirit and scope of the invention as set forth in the appended claims and as the same will now be understood by those skilled in the art.

What is claimed is:

1. A rotary piston for a rotary piston mechanism of the Wankel type wherein said rotary piston is supported on an eccentric portion of a mainshaft for planetary motion within a cavity formed by contiguous peripheral and side walls of a housing, the rotary piston comprising:

(a) a body having opposite side faces and a plurality of flank surfaces which intersect each other to form apex portions;

(b) said body having a central hub portion for supporting the rotary piston on said eccentric portion;

(c) a first seal groove in each apex portion extending between the opposite side faces of the body and radially inward from the intersection of the blank surfaces for receiving therein an apex seal means;

(d) second seal grooves in each side face extending adjacent each flank surface for receiving side seal strips, each groove having a bottom and opposite side walls extending between next adjacent apex portions of the body;

(e) first passages of relatively small flow area extending in the apex portions of said body adjacent each flank surface and in close spaced substantially parallel relation to each of said first seal grooves;

(f) second passages of relatively small flow area extending in said body adjacent each flank surface and extending in close spaced co-extensive relationship with the bottom wall of each of the second seal grooves to communicate at opposite ends thereof with said first passages of the associated flank surface to form for each flank surface a closed-loop passageway;

(g) inlet means in and adjacent one side face of the said body to communicate each of said closed-loop passageways with a source of pressurized cooling fluid to deliver cooling fluid to the latter; and (h) an outlet means in and adjacent the other side face of said body communicating with each of the closed-loop passageways to carry away heated cooling fluid from the latter.

2. The apparatus of claim 1 wherein each of said outlet means having a restricted flow area to throttle cooling fluid flow and insure that the associated closed-loop passageway is filled with cooling fluid.

3. The rotary piston of claim 1 wherein said body comprises a plurality of parts connected together into a single unitary structure.

4. The apparatus of claim 1 wherein said source of pressurized cooling fluid includes an axial passageway in said mainshaft and a radially extending passageway communicating at one end with the axial passageway and at the opposite end with each of the inlet means as the rotor rotates relative to the mainshaft.

5. The apparatus of claim 3 wherein the outlet means includes a substantially, radially extending passage communicating the associated closed-loop passageway with the area surrounding said hub portion.

* * * * *